United States Patent [19]

Prunbauer

[11] 4,434,636

[45] Mar. 6, 1984

[54] LOCK HAVING A CYLINDER CORE AND A HOUSING

[75] Inventor: Kurt Prunbauer, Herzogenburg, Austria

[73] Assignee: EVVA-Werk Spezialerzeugung von Zylinder-und Sicherheitsschlössern GmbH & Co. KG, Vienna, Austria

[21] Appl. No.: 209,286

[22] Filed: Nov. 21, 1980

[30] Foreign Application Priority Data

Nov. 28, 1979 [AT] Austria ..... 7553/79

[51] Int. Cl.[3] ..... E05B 15/14; E05B 27/06

[52] U.S. Cl. ..... 70/358; 70/364 A; 70/421

[58] Field of Search ..... 70/358, 364 A, 386, 70/419, 421

[56] References Cited

U.S. PATENT DOCUMENTS

| | | | |
|---|---|---|---|
| 758,026 | 4/1904 | Taylor | 70/421 |
| 1,985,889 | 7/1934 | Fitzgerald | 70/419 |
| 4,012,931 | 3/1977 | Haruneri | 70/386 |
| 4,250,725 | 2/1981 | Prunbauer | 70/358 |
| 4,356,713 | 11/1982 | Widen | 70/364 A |

FOREIGN PATENT DOCUMENTS

| | | | |
|---|---|---|---|
| 73832 | 2/1952 | Denmark | 70/421 |
| 2351310 | 5/1974 | Fed. Rep. of Germany . | |
| 2003059 | 11/1979 | Fed. Rep. of Germany . | |
| 2055948 | 3/1981 | United Kingdom | 70/364 A |

*Primary Examiner*—Robert L. Wolfe

*Attorney, Agent, or Firm*—Michael J. Striker

[57] ABSTRACT

The cylinder lock includes, in addition to conventional segmented tumbler pins, auxiliary tumbler elements movable at an oblique angle relative to the keyway and being engageable at one end into arresting recesses in the housing; the other end of the auxiliary tumbler cooperates with a camming surface on a feeler pin, the end of which projects into the keyway and is controlled by corresponding recesses provided on lateral sides of the key.

4 Claims, 16 Drawing Figures

LOCK HAVING A CYLINDER CORE AND A HOUSING

BACKGROUND OF THE INVENTION

The invention relates in general to a cylinder lock, and in particular to a lock having a core provided with a keyway adapted for receiving a key having on one side thereof recesses or projections for controlling arresting tumblers of the lock and also having longitudinal ribs or grooves formed on another side thereof to cooperate with complementary guiding grooves or ribs in the keyway.

Locks of the above-described kind are known and particularly in the form of cylinder locks having two or more segmented tumbler pins are in wide use. Locks are also known in which single-piece tumbler pins are brought by the inserted key into the arresting or releasing position. Nevertheless, all these known locks have various disadvantages as regards the limitations of their number of variations, the safety against scanning and the safety against forcible opening.

SUMMARY OF THE INVENTION

It is therefore a general object of the present invention to overcome the aforementioned disadvantages.

More particularly, it is an object of the invention to increase the number of code variations of the lock, to improve the protection against scanning contact and also to increase the resistance of the lock against forcible opening.

In keeping with these objects, and others which will become apparent hereafter, one feature of the invention resides, in a cylinder lock of the aforedescribed type, in the provision of additional tumblers movably arranged in the core at an oblique angle relative to the keyway and cooperating with feeler elements which are also movably arranged in the core to cooperate with predetermined recesses and projections formed on the lateral guiding grooves and ribs of the key. The latter recesses and projections on the guiding ribs are preferably made in the central range of the key. In a modification, the recesses and projections for controlling the feeler elements are formed on the back side of the key so that the latter, in the range of its bit range on the front side, has sufficient room for the provision of cut-outs, recesses and projections for controlling the conventional main tumbler means. The feeler elements in the cylinder core in this case are arranged obliquely to the central plane of symmetry of the keyhole or the key. Preferably, the width of the key in the range of its key bits and the corresponding width of the keyway is less than that of the key rear side and the transition between the bit side and the rear side is in the form of a step which is directed substantially at right angles to the direction of movement of the feeler elements while the control surfaces of the recesses extend parallel to the latter movement.

According to another feature of this invention, the feeler elements or pins are shaped with recessed cam surfaces engaging the additional tumbler means and, as mentioned before, the feeler elements are movable in guiding bores in the cylinder core. In a modified embodiment of this invention, the guiding bores are arranged in such a manner that they communicate both with the keyway and with the plane of separation between the core and the housing and the feeler pin has at least the length which corresponds to the clearance between the separation plane and the assigned recess in the key.

In a particularly advantageous embodiment of this invention, the additional tumbler means are in the form of cylindrical pins movable in corresponding bores in the core and engageable at one end thereof with the housing and at the other end with recessed control cams in the feeler pins when the latter are displaced by the key into their releasing position or in contact with the cylindrical surface of the feeler pins when the latter in their arresting position. The additional tumbler elements may be also in the form of balls.

According to still another embodiment of this invention, the additional tumbler elements can be arranged at one side of the core and may have the form of a continuous bar which is movable in a corresponding slot extending in radial direction toward the assigned feeler pins whereby the inner wall of the housing is formed with an axially directed continuous groove for engaging the tumbler bar when the core is angularly displaced into its arresting position.

In a further embodiment of the lock of this invention, the additional tumbler means having the form of the aforementioned continuous bar or rod arranged for movement in a guiding slot extending in the core in axial direction whereby the tumbler rod is provided with extensions directed toward the feeler pins to engage their recessed cams when the core is turned in the corresponding angular position and at the opposite side is provided with arresting pieces projecting into an axial recess whereby the inner wall of the housing is formed with radial ring-shaped grooves for guiding the arresting pieces during the rotation of the core.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
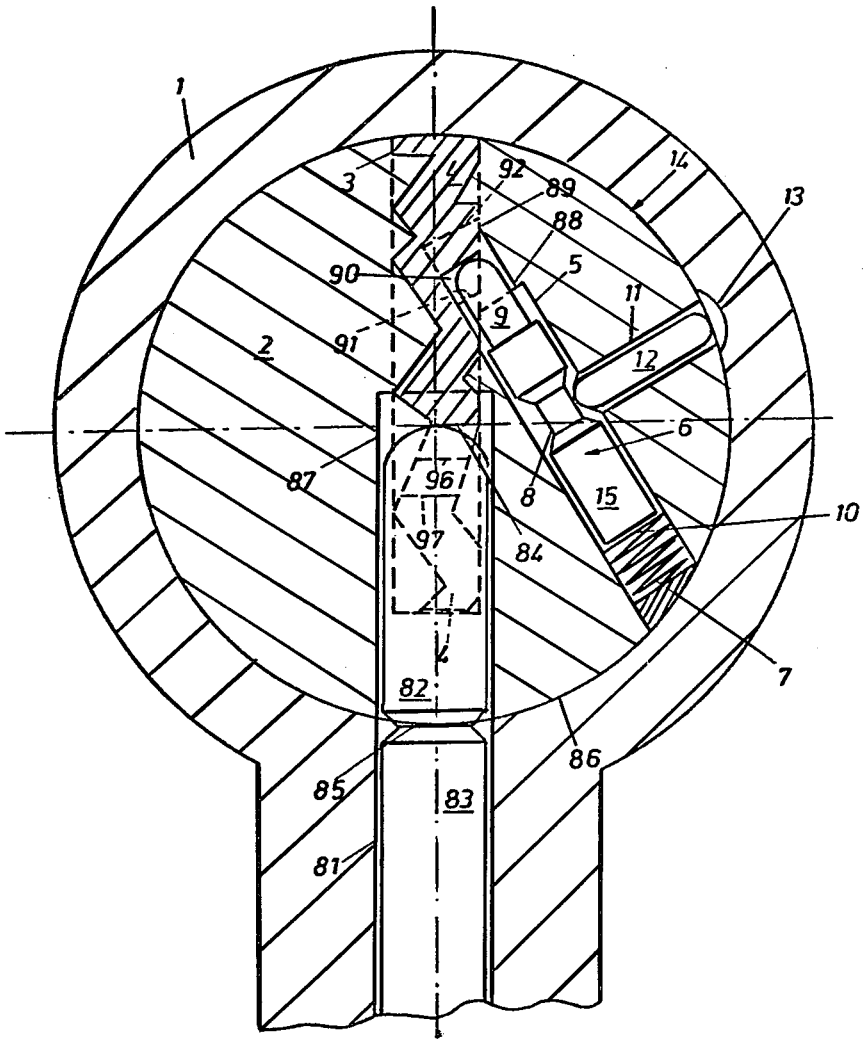
FIG. 1 is a radial cross section of one embodiment of the cylinder lock of this invention.
Figure 2:
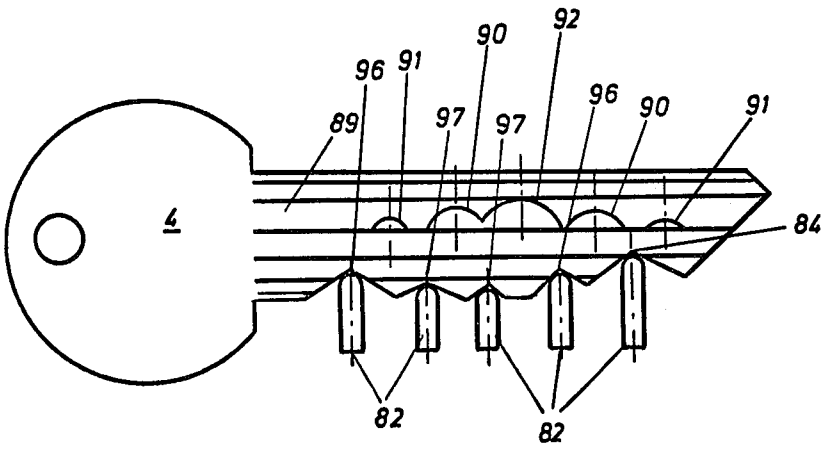
FIG. 2 is a side view of a key pertaining to the lock of FIG. 1.
Figure 3:
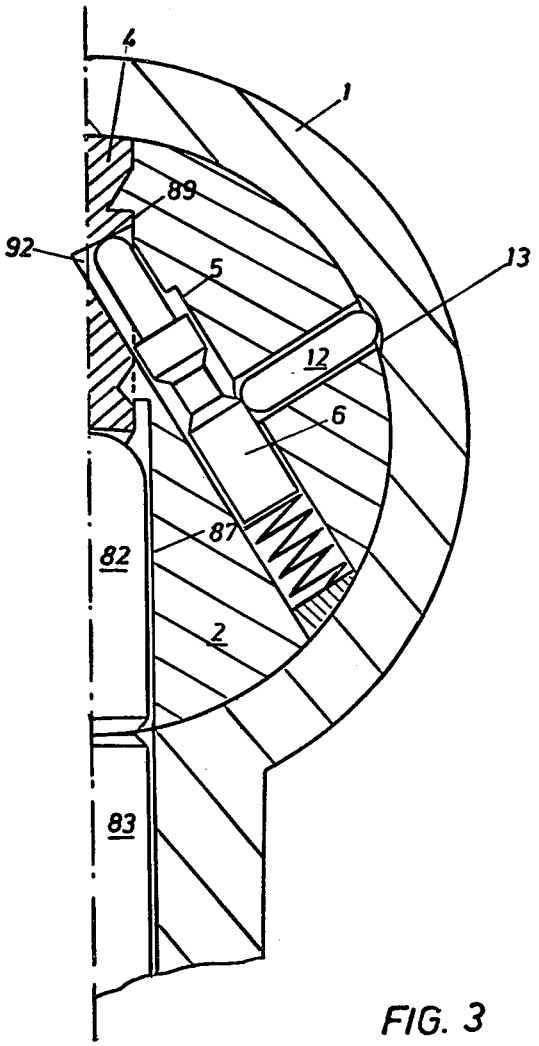
FIG. 3 is a cutaway section of the lock according to FIG. 1 shown in another of its functional positions.

Referring firstly to FIGS. 1 and 3, the cylinder lock of this invention includes a housing 1 with a cylindrical axial bore which accommodates for rotation a cylinder core 2. The cylinder core is provided with an axially directed keyway or key channel 3 for receiving a key 4. The rear face of the cylinder core 2 is connected in a known manner with a non-illustrated locking nose which, upon the insertion of the right key, is rotated together with the core 2 to control the locking or unlocking position of the corresponding locking bolt with respect to the part of the lock in the doorframe. In the plane of the key channel 3, the core 2 and the housing 1 are provided in a known manner with registering bores 81 and 87 in which segmented tumblers formed in this embodiment by a core tumbler pin 82 and a housing tumbler pin 83 are arranged. Each housing tumbler segment 83 is biased by a non-illustrated spring to press against the aligned core tumbler pin 82 and by displacing the same upwardly it locks the core with respect to its housing. By inserting the notched portion 84 of a correctly matching key 4 into the key channel 3, the tumbler pin segments 82 and 83 are displaced into a position in which their separation plane 85 coincides with the separation plane 86 of the core and the housing and consequently the rotational movement of the core 2 is made possible. Other indentations 96 and 97 on the front edge of the key 4 as depicted in FIG. 2, are indicated by dashed lines in FIG. 1. As it is well known from prior art, the cylinder locks of this kind are equipped with a plurality of such segmented tumbler pins which are arranged one after the other along a line. When designing more complex cylinder lock units, there is also possible to employ tumbler pins consisting of a still increased number of segments.

Core 2 is also formed with bores 5 extending at an oblique angle relative to the key channel 3 and each bore 5 slidably guides a feeler pin 6 which is biased against the keyway by biasing springs 7. In this embodiment, the oblique bore 5 extends all the way between the periphery of the core and the key channel and is machined with a step 88 which of course may be also made by the insertion of a suitable sleeve.

Each feeler pin 6 is shaped with a recessed cam 8 in the form of an annular groove and its end portion projecting into the key channel is rounded and reduced in diameter. The opposite end 10 of the feeler pin is flat and serves an abutment surface for the biasing spring 7. The recessed cam 8 can be arranged at different circumferential sections of the feeler 6; the intermediate location of the cam 8 as illustrated in FIGS. 1 and 3 is only one of many possible locations which will be discussed below in connection with FIGS. 6–11. Due to the step-like configuration of the bore 5 and of the feeler pin 6, it is attained that the latter does not override too far into the key channel 3.

Figure 15:
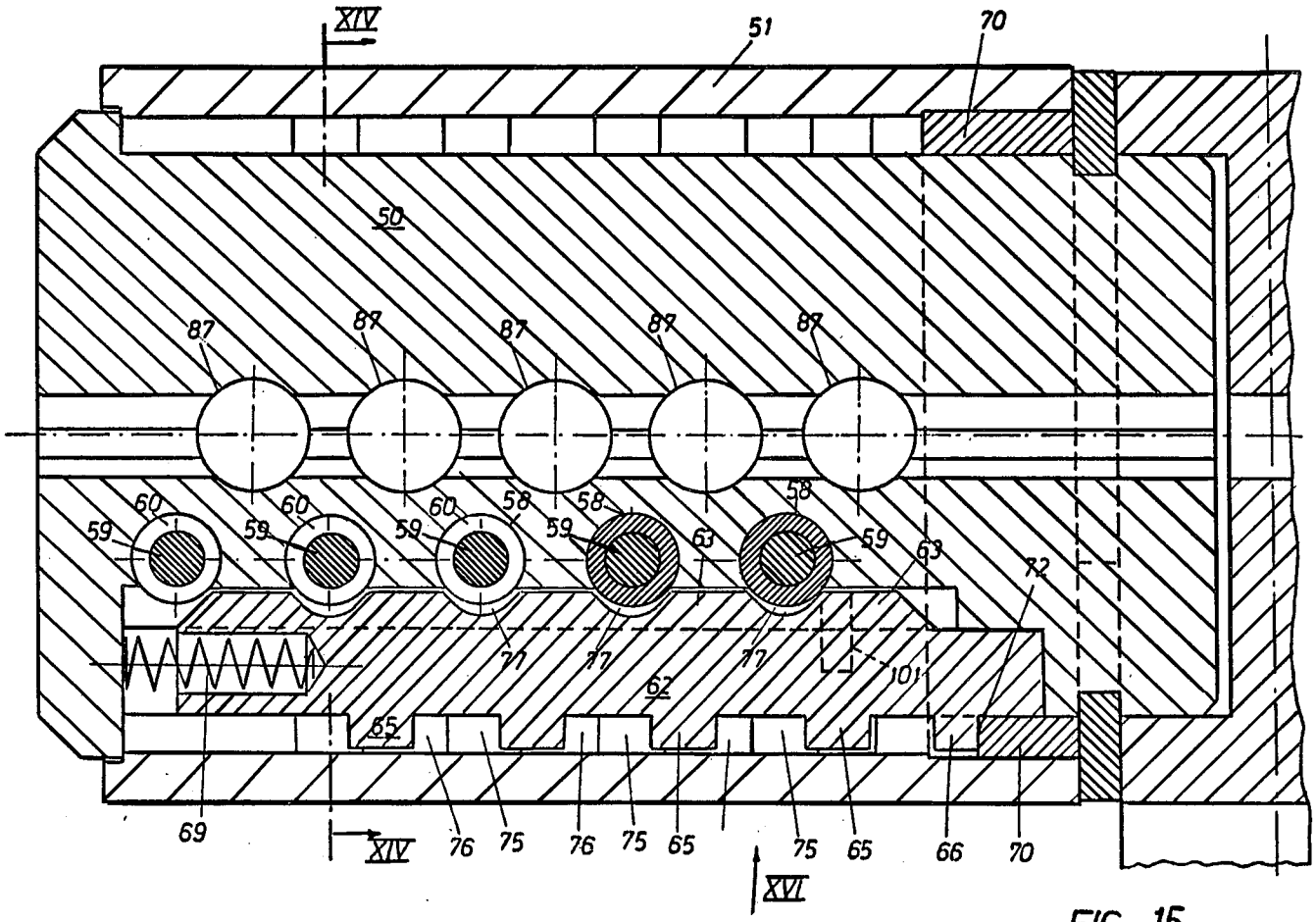
FIG. 15 is a sectional view of the embodiment of FIG. 14 taken along the line XV—XV.

An additional bore 11 in the core 2 extends perpendicularly to the bore 5 and communicates with the latter in the region of the recessed cam 8 in the feeler pin 6 and also communicates with the peiphery of the core 2. An auxiliary single-piece tumbler pin 12 is movable in the additional bore 11 and its length is adjusted such that when one end thereof is in engagement with the recessed cam 8, the other end is flush with the circumference of the core 2; or in another position of the feeler pin 6, when the one end of tumbler 12 is in contact with the circumference of the pin 6, the other end thereof is in engagement with an arresting recess 13 formed in the central bore of the housing 1. Both ends of the auxiliary tumbler pin 12 are rounded. As discussed before in connection with the main tumbler pins 83 and 82, more auxiliary pins 12 can also be arranged in an axial direction in bores one after the other as indicated in the simple embodiment in FIG. 1. In the preferred embodiment, however, the main tumbler pins 82 and 83 as well as the feelers 6 are not arranged in common planes, respectively, but are staggered in axial direction relative to each other about half of their spacing, as depicted in FIG. 15 by bores 87 and 58.

The cylinder lock according to FIG. 1 is illustrated with an inserted correct key 4 which is shaped to axially displace the feeler pin 6 against the biasing spring 7 situated in the bore 5. The key 4 has on a lateral side 89 recesses 90 and 91 the depth of which determines the position of the corresponding feeler pin 6. As seen from FIG. 1, the matching key 4 has recesses 90 of such a depth that the feeler pin 6 is depressed into its bore 5 about a distance which corresponds to the registering position of the recessed cam 8 and the perpendicular bore 11 for the auxiliary tumbler pin 12, and the latter is displaced inwardly to contact the lowermost surface of the cam 8. The force necessary for this inward displacement of the pin 12 is exerted during the rotation of the core 2 when the rounded outer end of the pin 12 slides on the rounded surface of the arresting recesses 13. Accordingly, both the tumbler pins 83 and the auxiliary tumbler pin 12 are disengaged from the core or from the housing, and consequently the cylinder core is free to rotate. During the rotary movement, the key is held in position by the main tumbler pin segments 82 and by the feeler pin 6 and consequently during the rotation it is impossible to withdraw the key from the lock. The withdrawal is possible only upon the completion of the rotation about 360° when the non-illustrated biasing springs press main tumbler segments 83 into the bores 87 of the core and the auxiliary tumbler pins 12 are again in register with the arresting recesses 13 in the inner wall 14 of the housing.

Provided that it is desired to control the cylindrical lock by a matching key having another form of the lateral recesses 90, such as indicated by dash lines 91 and 92 in FIG. 1, it is only necessary to provide feeler pin 6, with a recessed cam 8 which is axially shifted according to the changed position of the new recesses 91 or 92. The overall length of the feeler pin 6 remains the same, that means the shorter is the front portion 9 of the feeler, the longer is its rear portion 15. If desired, it is also possible to extend the axial range of the recessed cam 8 or to form two recessed cams one after the other so as to fit more than one of the lateral recesses 90 through 92 on the key 4. In this manner, several keys each having different locations of the lateral recesses may actuate the lock.

The auxiliary arresting recesses 13 in the housing 1 can be made also in the form of a continuous groove. In still another variation, it is also possible to provide a set of feeler pins 6 and of auxiliary tumbler pins 12 on both sides of the key so that the locking safety of the lock be considerably increased.

FIG. 2 illustrates an example of a key for the cylinder lock of this invention. The key has conventional recesses and projections on the front edge thereof cooperating with five tumbler pins 82 and in addition the lateral side of the key is formed with five lateral recesses 90–91 cooperating with the feeler pin 6. The operation of the lateral recesses is obvious from the preceding description of the function of the tumbler pin 6.

In FIG. 3, there is illustrated the same lock as in FIG. 1 after an incorrect key having a mismatching lateral recess 92 has been inserted into the key channel 3. Inasmuch as the incorrect recess 92 is too deep, the feeler pin 6 is pushed by its biasing spring to such an extent into the key channel 3 that the auxiliary tumbler pin 12 is displaced by the central camming surface outwardly to engage with one end the circumference of the feeler 6 and with the other end the arresting hole 13 in the cylinder 1. As a consequence, it is no longer possible to turn the core 2 by the unfitting key.

FIGS. 4–11 illustrate another embodiment of the cylinder lock of this invention.

Figure 4:
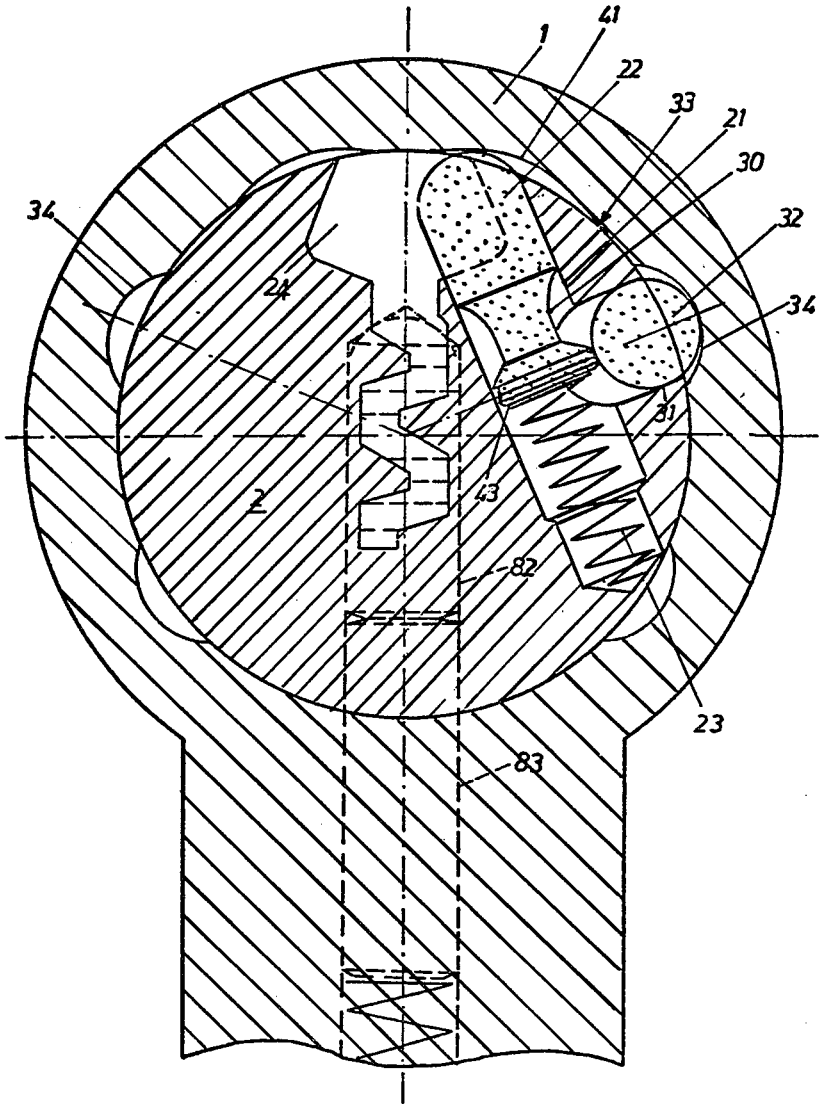
FIG. 4 is a radial section of another embodiment of the cylinder lock of this invention.

Similarly as in the preceding example, the cylinder core 2 is provided with bores 21 in which feeler pins 22 are movably arranged and biased by springs 23. Each bore 21 is directed at an oblique angle to a lateral side of the key channel 24 in the core 2. In FIG. 4, the position of the feeler pin is indicated when no key is inserted in the channel 24. The feeler pin 22 is again shaped with a recessed cam 30 in the form of an annular groove. An additional bore 31 is formed in the core 2 and extends at right angles to the feeler bore 22. In this example, an auxiliary tumbler 32 in the form of a ball is movable between the inner surface 33 of the housing 1 and the feeler bore 22. The inner surface 33 is again provided with arresting recesses 34 which at a certain angular position of the core engage the tumbler ball 32. Inasmuch as no key is inserted in the lock according to FIG. 4, the biasing spring 23 presses the feeler pin 22 into its rest position in which its rounded end rests on the inner surface 33 of the cylinder housing 1. The main tumbler pin 83 is in its arresting position in which it engages the core 2. The inner wall of the housing 1 in the range of the head of the feeler pin 22 is provided with a shallow first recess 41 the purpose of which is to delay somewhat the movement of the feeler pin against the biasing spring when the core is rotated by the key. The rear end portion of the feeler pin 22 is formed with a flange 43 which in the rest position of the feeler 22 keeps the auxiliary tumbler ball 32 in engagement with an arresting recess 34 in the housing 1, thus providing an auxiliary arresting point in addition to the arresting points of main tumbler pin segments 82 and 83 indicated in FIG. 4 by dash lines.

Figure 5:
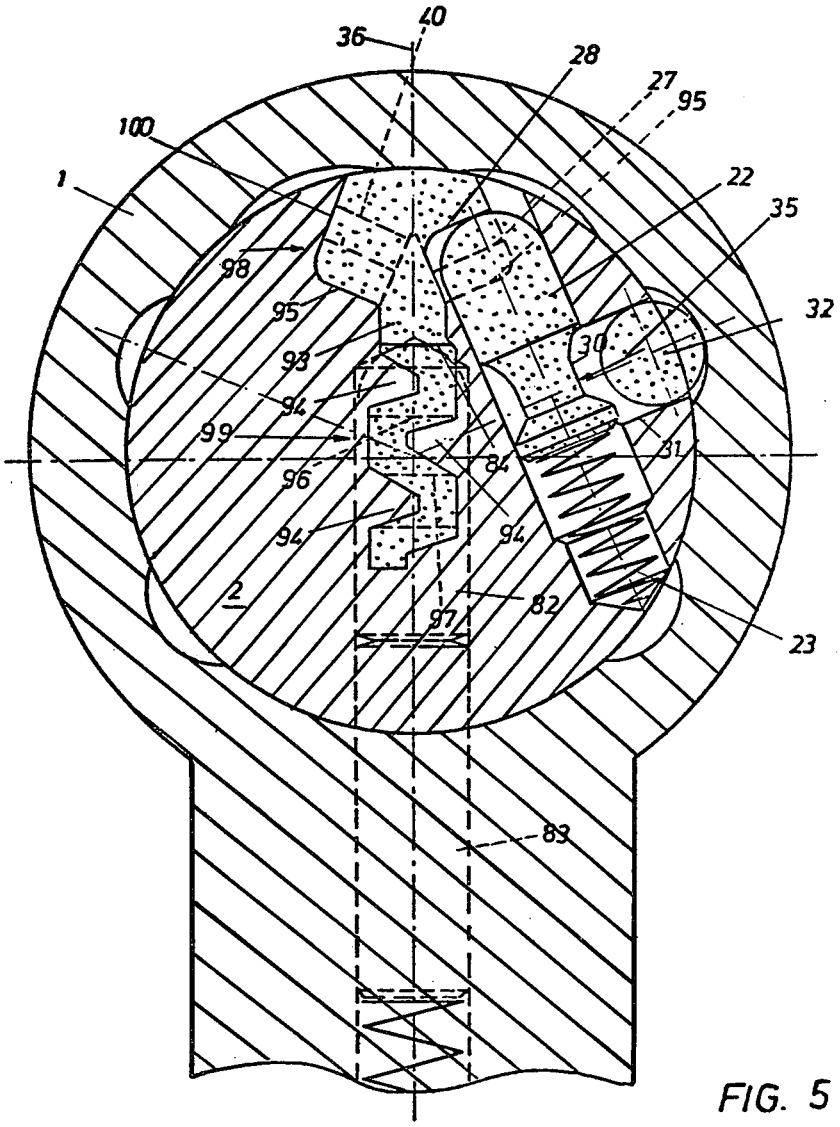
FIG. 5 is the embodiment of FIG. 4 shown in another functional position.

In FIG. 5 there is illustrated the same lock as in FIG. 4 after a correct key 93 has been inserted into the key channel of the core 2. The key 93 has a longitudinal bit portion 99 which is reduced in thickness relative to its rear portion 98. The bit portion of the key defines superimposed longitudinal grooves which are guided in complementary projections 94 in the key channel of the core 2. The purpose of the guiding projections 94 is to render an unauthorized scanning of the main tumbler pins 82 and 83 more difficult. The transition part between the bit portion and the rear portion of the key is in the form of a step 95 which forms an abutment surface which is oriented perpendicularly to the axis of the feeler pin 22. The step 95 can extend over the entire length of the key 93.

One flank of the step 95 is formed with a recess 28 the depth of which is adjusted for correct positioning of the feeler pin 22 so that the recessed cam 30 in the feeler pin be juxtaposed the bore 31 in the housing and the auxiliary tumbler ball 32 be released for movement into its bore 31. By rotating the core 2 the ball 32 is now displaced in the direction of arrow 35 and enters the recessed cam 30 in the feeler pin 22. Since the key in a conventional manner also displaces the main tumbler pins 82 and 83, the separation plane between the core and the housing is now set free and the core 2 can be rotated to unlock the non-illustrated bolt.

Figure 6:
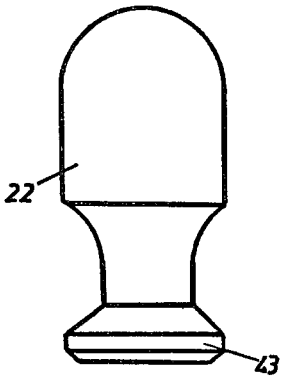
FIGS. 6–11 show, respectively, various configurations of feeler pins in the embodiment according to FIGS. 4 and 5.
Figure 7:
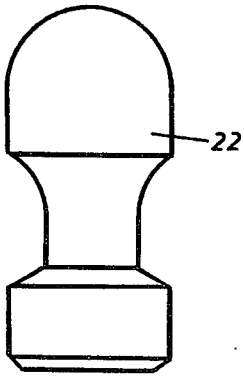
Figure 8:
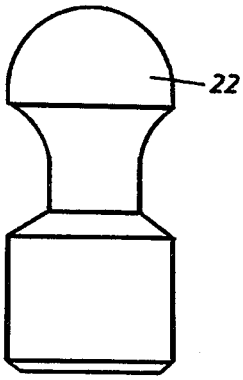

Also in the embodiment according to FIGS. 4 and 5 the recessed cam 30 on the feeler pin 22 can be formed at different locations or extended in length. The three principal variations of the feeler pin 22 are illustrated in FIGS. 6–8. The embodiment according to FIG. 4 employs the feeler pin having the configuration according to FIG. 6 and, as explained before, the recesses 28 on the key are adjusted in depth so as to match the axial position of the recessed cam 30. For example, when a feeler pin according to FIG. 7 is employed, the depth of the recess 27 on the key, as indicated by dashed lines, is less than in the preceding example. When a feeler pin 22 according to FIG. 8 is used in the embodiment according to FIGS. 4 and 5, it is the step 95 itself which acts as a control surface for the rounded head of the feeler pin and in this case the depth of the recess is zero.

In the embodiment according to FIGS. 4 and 5, the feeler pins and auxiliary tumbler elements are arranged on one side of the cylinder core only. It is to be understood, however, that the auxiliary tumblers and feelers can be symmetrically arranged on both sides of the plane of symmetry 36, whereby the key 93 is provided on both lateral sides with control recesses 38–40. Obviously, it is also possible on each side of the key channel to provide several consecutively arranged feeler pins with corresponding auxiliary tumbler elements so that the lock of this invention has, apart from the conventional main tumbler segments, two rows of feeler pins 22 and tumbler balls 32 to increase the variations of the code of the lock.

Figure 9:
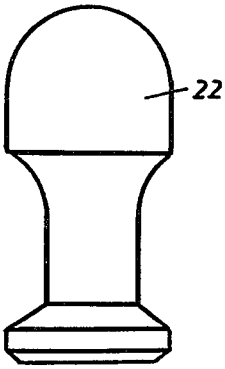
Figure 10:
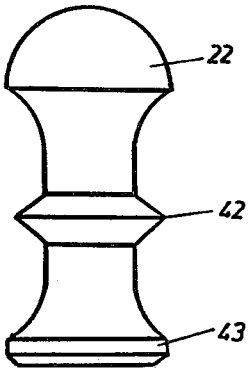

In FIGS. 9 and 10 modifications of feeler pin 22 are depicted which enable corresponding variations in the arresting function of the lock. In particular, the tumbler pin according to FIG. 9 responds to control recesses 27 and 28 on the key assigned both to the feeler pin according to FIG. 6 and to that according to FIG. 7. The feeler pin according to FIG. 10 has two recessed cams combining those as depicted in FIGS. 6 and 8; the feeler pin according to FIG. 10 is therefore responsive to lateral key recesses 28 and 95. If desired, the intermediate flange or land 42 can be dispensed with, in which case the key having any of control recesses 95, 27 or 28 of different depths can be used to release the auxiliary tumbler ball and the core is arrested only by the rear portion 43 of the feeler pin 22 when the key is withdrawn.

Figure 11:
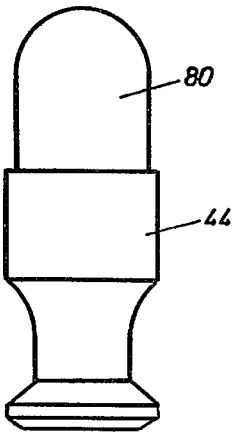

Control recesses 29 and 40 indicated by dashed lines on the left side of the key have a depth adjusted for displacing the feeler pin from engagement with a corresponding concave recess 41 in the wall 33, similarly as indicated in FIG. 4. The feeler pin according to FIG. 11 is longer than that of FIG. 6 about the distance between the recesses 28 and 29. If no key is inserted in the lock, the feeler pin 34 is in its rest position and a key with a recess 29 displaces the feeler pin 44 in its releasing position. The modification of the feeler pin employing the additional portion 80 is suitable for designing and manufacturing lock installations for special applications.

Such a variation is advantageous particularly in the case when, for example, in a set of locks a master key is used which is designed for closing all locks in the set except one. In the latter case, the feeler pin 44 has its end portion 80 of a reduced diameter so that the control recess 29 in the lateral side of the key 93 is correspondingly smaller and more material remains on the key so that the key is stronger.

The rear side of the key 93 tapers toward the separation plane between the core 2 and the housing 1 whereby the converging flanks 100 are oriented in the direction of movement of the assigned feeler pins 22.

Figure 12:
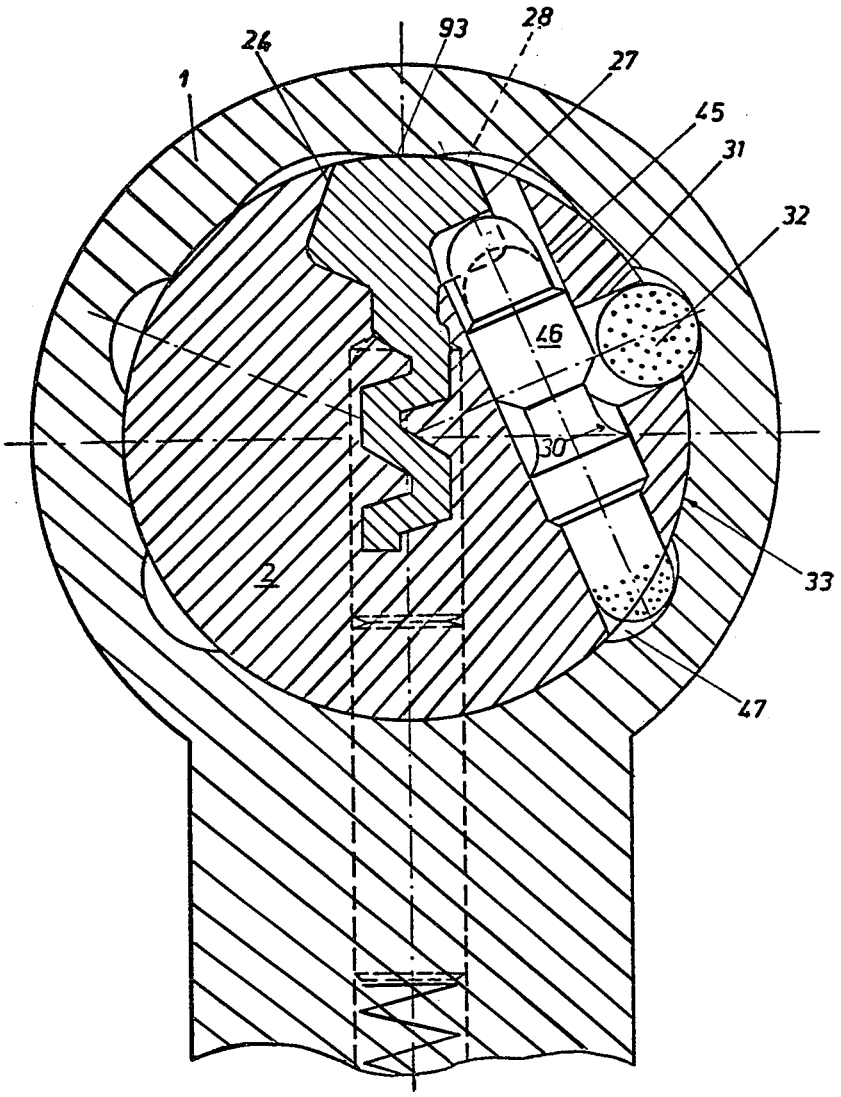
FIG. 12 is a radial cross section of a structural modification of the embodiment according to FIGS. 4–11.

A modified version of the embodiment of the lock of this invention according to FIGS. 4 and 5 is illustrated in FIG. 12. In this embodiment, bore 45 for the feeler pin is in the form of a throughgoing passage extending at an oblique angle between the key channel and the circumference of the core 2. Passage 45 has an internal step and the feeler pin 46 has a corresponding annular flange which limits its movement toward the housing 1. The length of the feeler pin 46 is greater than in the preceding embodiment and one end of the feeler pin projects into the key channel 24, while the other end projects into an arresting recess formed in the inner wall 33 of the housing 1. A biasing spring in this case is unnecessary, since the movement of the feeler pin 46 into the key channel is effected by the camming action of the curved flanks of the recess 47 in the housing 1. In the example in FIG. 12, an incorrect key 93 is inserted into the key channel because its controlling recess 27 blocks the axial movement of the pin 46 and keeps its other end in the recess 47. An additional blocking action results from the arresting position of the auxiliary tumbler ball 32. Only if a correct key is inserted having an adjusted control recess 28 on its lateral side, the feeler pin 36 during the rotation of the core 2 can be axially displaced about a distance which permits the ball to enter the recessed camming surface 30 and the other end to clear the arresting recess 47 so that the core 2 can rotated about its full angle.

Figure 13:
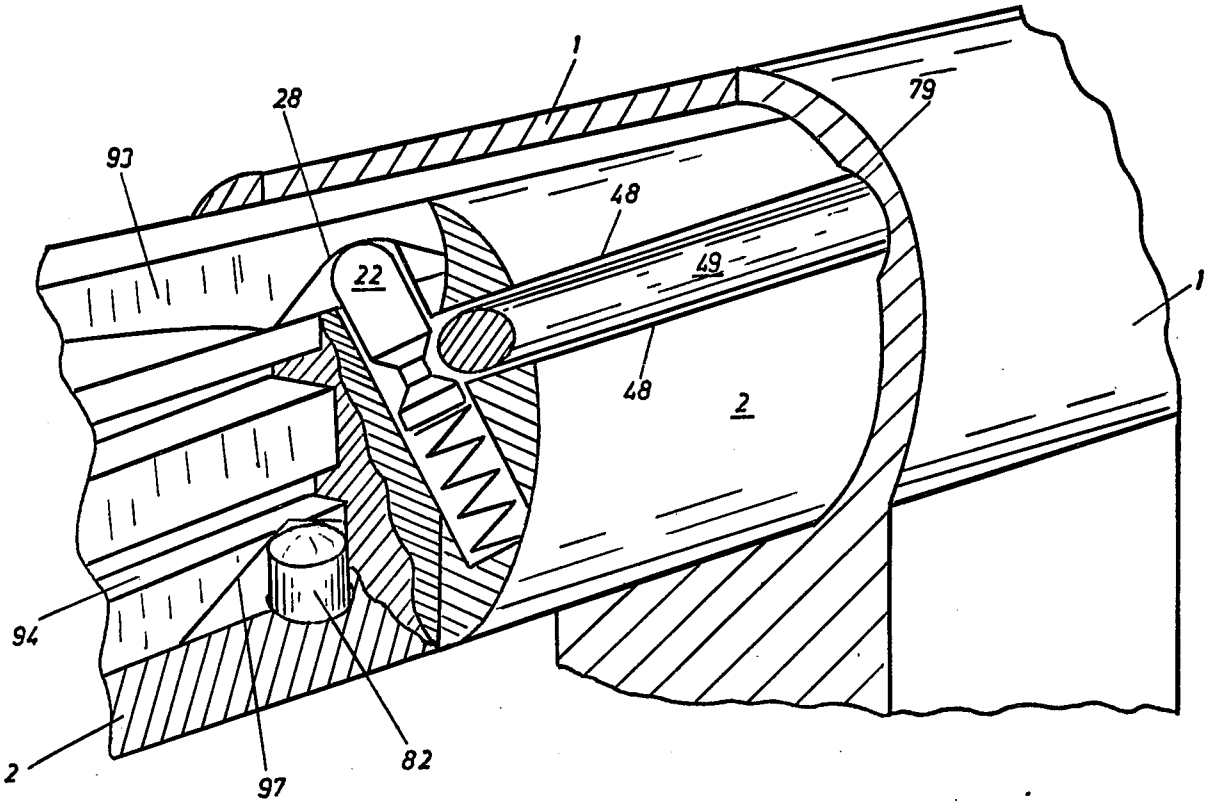
FIG. 13 is a perspective view, partly in section, of a cutaway portion of still another modification of the embodiment according to FIG. 4.

In the hitherto described constructions of the lock of this invention according to FIGS. 1–12, there are always employed discrete auxiliary tumbler elements 12 or 32 cooperating with discrete feeler pins 6 or 22 and 46. According to still another modification of this invention, it is possible to create the auxiliary tumbler elements located at one side of the key channel,in the form of a continuous rod which cooperates with individual feeler pins arranged on the same side of the core. This modified solution is depicted schematically in FIG. 13. Instead of bores 11 or 31 for the auxiliary tumbler element, there is provided in the core an axial slot 48 for guiding in radial direction an elongated rod 49 having a circular cross section. The inner wall of the housing 1 is formed with a corresponding axial groove 79 for engaging the rod 49 when one or more feeler pins 22 are in their arresting position. In other details, this construction corresponds to that according to FIGS. 4 and 5. The advantage of the modification according to FIG. 13 is the fact that the common arresting rod 49 can withstand considerable forces arising, for example, when the core is forcibly rotated by a false key. In the case of discrete auxiliary tumbler pins, the resistance against such a mistreatment is less than in the case of the continuous rod. From FIG. 13 it is also apparent that the position of the main tumbler segment 82 is staggered between the spacing of feeler pins 22.

Figure 14:
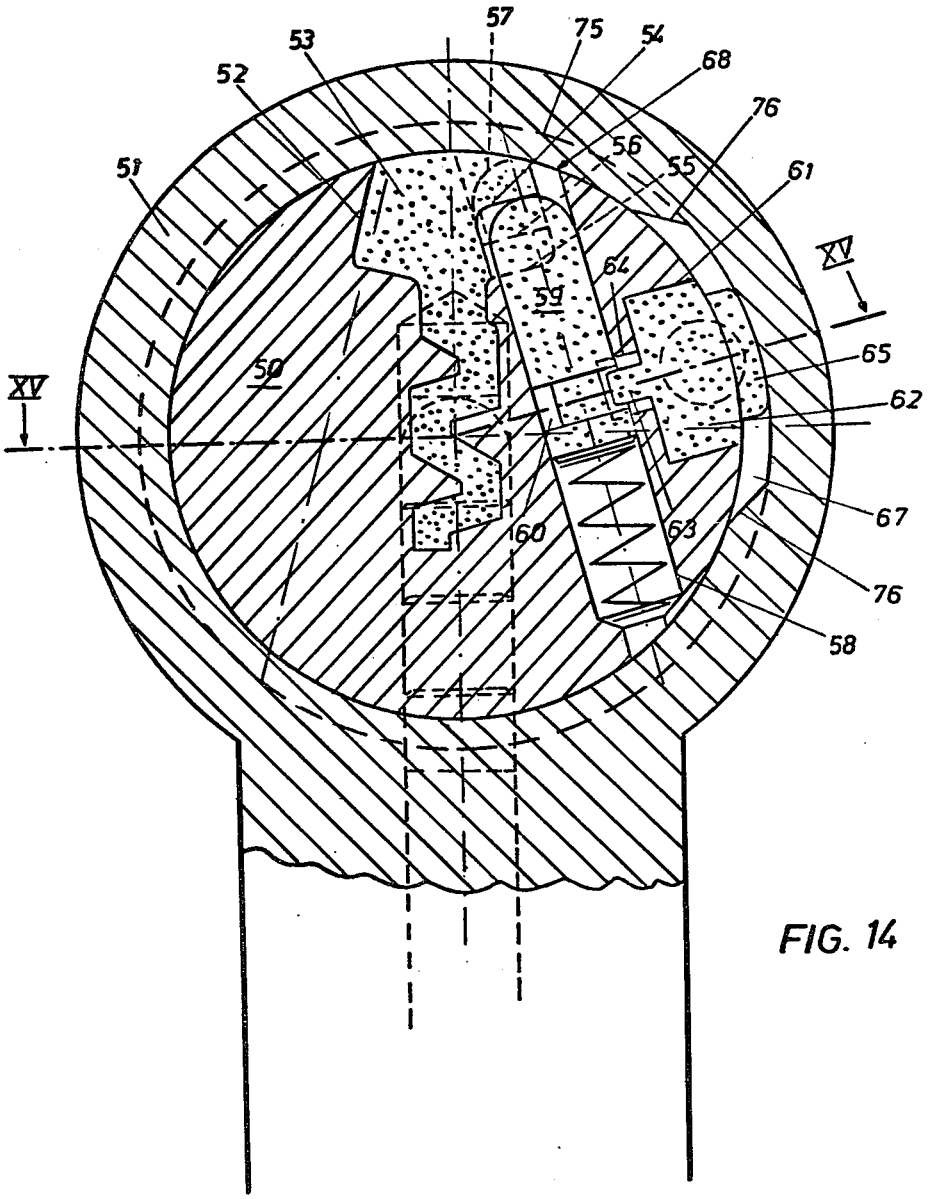
FIG. 14 is a radial section of still another embodiment of the lock of this invention, taken along the line XIV—XIV in FIG. 15.
Figure 16:
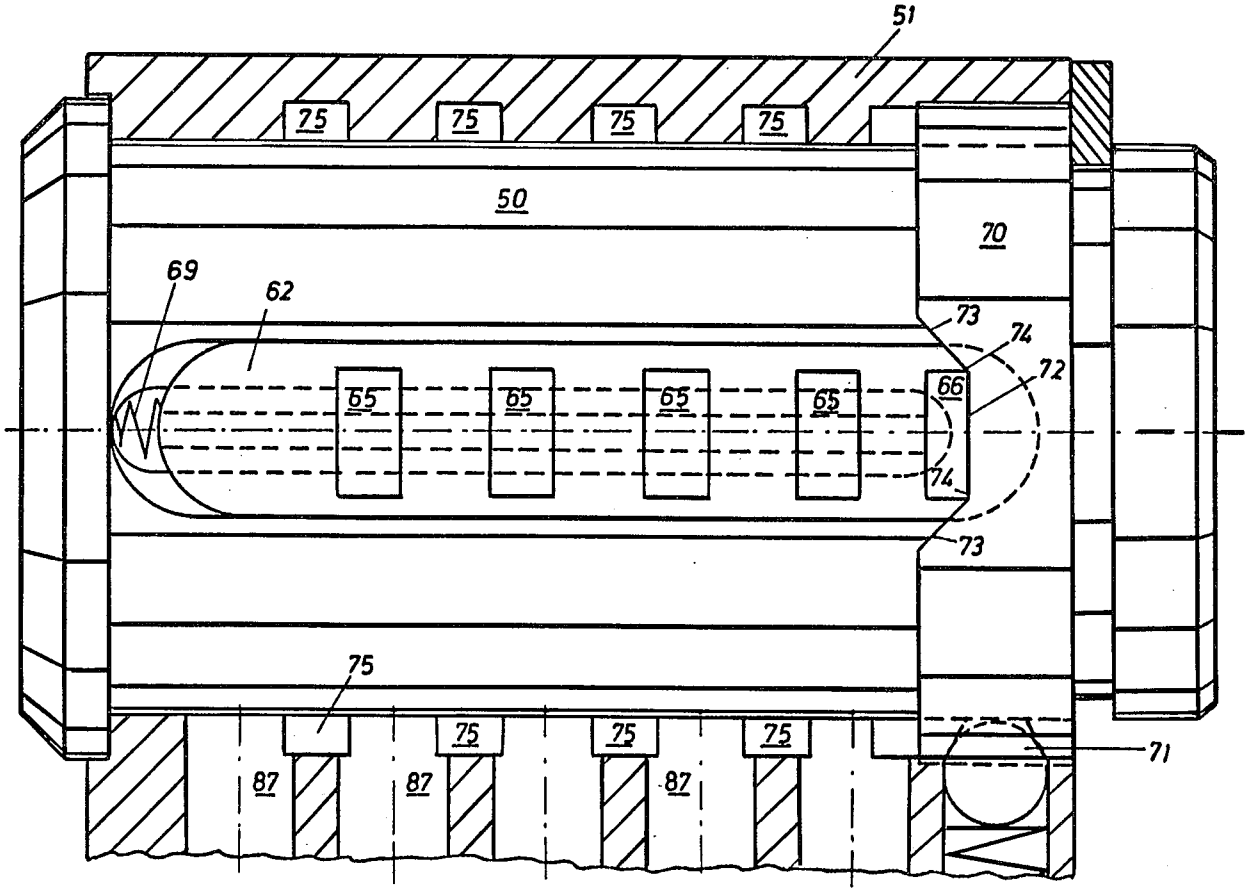
FIG. 16 is a plan view, partly in section, of the embodiment of FIG. 15, taken in the direction of arrow XVI.

Still another embodiment of the lock of this invention is illustrated in FIGS. 14–16. Even in this example a core 50 is arranged for rotation in a cylindrical housing 51. A key 53 having lateral control recesses 54 is inserted into a key channel 52 in the core. Additional control recesses or surfaces are indicated by reference numerals 55–57. A bore 58 extends at an oblique angle to the key channel 52 and slidably guides a feeler pin 59. The feeler pin 59 in this embodiment is formed with an annular groove 60 which, by contrast to the preceding example, is not formed with inclined camming surfaces but is formed with deep walls. An axial groove 61 is formed in the outer surface of the core 50 opposite the feeler pins 59 so that it extends parallel to the consecutively arranged bores 58. The groove 61 guides for axial displacement a continuous arresting bar 62 which is shaped with radial projections 63 projecting through axial groove 64 into respective oblique bores 58 for the feeler pins 59. At the opposite side, the arresting bar 62 is provided with arresting extensions 65 and 66 which in the rest position of the lock engage an axial recess 67 in the inner wall 68 of the housing 51. Within the range of the axial recess 67, the arresting bar 62 is free to move within the limits of the slot 61. A biasing spring 69 presses the arresting bar 62 toward a stop ring 70 which is arranged at the inner end of the core 50 and which is freely rotatable relative to the core and to the housing. A certain fixation of the position of the ring relative to the housing is ensured by a spring-biased ball arrester 71. The stop ring 70 has an axial recessed portion 72 formed with radial camming surfaces 73. The last outer extension 66 of the arresting bar 62 abuts against the recessed portion 72 of the stop ring and its edges cooperate with camming surfaces 73 of the latter.

The inner surface 68 of the housing 51 is formed with a series of annular grooves 75 arranged one after the other and communicating with the axial groove 67. The width of respective annular grooves 75 is sufficient for receiving respective arresting outer extensions 65 and 66 of the arresting bar 62. When the arresting bar 62 is shifted out of the recessed part 72 of the stop ring 70, the arresting extensions 65 and 66 in the latter axial position are in register with the annular grooves 75, and consequently the core 50 together with the arresting bar 62 can be rotated relative to the housing. In the other stable axial position of the bar 62 as depicted in FIG. 16, the arresting projections 65 and 66 are out of alignment with the assigned annular grooves 75 and consequently abut against the stop surfaces 76 of the axial groove 67. In this case the core 50 cannot be rotated.

FIG. 14 illustrates this embodiment with the inserted correct key provided with lateral control recesses 54 of correctly adjusted depth. As a result, the annular recess 60 of the feeler pin 59 has been displaced opposite the inner extension 63 of the arresting rod 62 and consequently the outer extensions 65 are disengaged from the flanks of the axial recess 67, and core 50 is free to rotate. As seen from FIG. 15, the left side feeling pins 59 have already attained the releasing position depicted in FIG. 14; the two right side feeling pins 59, however, are still in their blocking position in which the full cross section of the feeler pin is in contact with the inner extension 63 of the arresting or tumbler bar. Before the completion of the proper displacement of all feeler pins 59, the rotation of the core would be impossible.

As already explained, when all feeler pins 59 release the arresting bar 62 and the core is free to rotate relative to the cylinder housing, the arresting bar 62 rotates together with the core. In doing so, the run-on surface 74 of the last arresting projection 66 follows one of the inclined surfaces 73 of the recessed portion in the stop ring 70 and displaces the whole arresting bar 62 in axial direction against the force of biasing spring 69. As soon as the last arresting extension 66 is displaced out of the range of the axial recess 72 in the stop ring, at this moment all arresting extensions 65 are in register with the annular groove 75 and the cylinder core 50 can be freely rotated until the lock bolt is activated.

If a false key is employed in the lock, then the feeler pins 59, or at least some of them, remain in the position corresponding to that of the two right-hand feeler pins 59 in FIG. 15. If it is attempted to rotate the core, the inner extensions 63 of the arresting bar 62 are blocked by the cylindrical outer surface of the feeler pins 59 and any axial displacement of the arresting bar is prevented. The rotational force applied against the core is transmitted on the stop ring 70 and overcomes the holding force of the arresting ball 71. The stop ring 71 is now rotated together with the core until the arresting extension 65 abuts against the stop surfaces 76 in the axial grooves 67 in the housing and the rotation of the core is stopped. The lock is now blocked, and any closing or opening operation is no longer possible.

The embodiment according to FIGS. 14–16 has the advantage that, in the event tackling the lock by a false key, the rotary forces acting on the relatively sensitive feeler pins 59 are limited to a magnitude which is necessary for overcoming the holding force of the ball arrester 71. Any subsequent rotary forces applied against the blocked core are directly intercepted by means of arresting extensions 65 and 66 and the stop surfaces 76 of the entire lock structure. The danger that the feeler pins 59 might be pressed out into the key channel 52 is thus eliminated.

Regarding the embodiment according to FIG. 14 it will be noted that the configuration of the extensions 63 on the arresting bar 62 can be made in different forms, for example as inserted bolts 101 indicated by dashed lines.

Also in the construction according to FIG. 13, the construction of the arresting rods 39 need not have a circular cross section but, in dependence on the depth of the axial groove 48, it can also have a non-circular cross section.

It will be understood that each of the elements described above, or two or more together, may also find a useful application in other types of constructions differing from the types described above. For example, in addition to the aforedescribed mechanical arresting or tumbler elements, it is also possible to apply magnetic tumblers such as for instance the so-called magnetic rotors so that the number of possible variations and the protection against scanning of the tumbler pins is still increased. Furthermore, it is also possible to employ different structural measures in order to prevent that the feeler pins project too deep into the key channel when the key is withdrawn so that the reinsertion of the key be not impeded. For instance from the outer side, the key channel can be formed with an inclined inlet. Also, the bores for the feeler pins can be shaped as stepped bores (FIGS. 1 and 3) so that the feeler pins, before contacting the inner surface of the housing, are stopped by the inner step. The feeler pins may have also an angular cross section instead of the circular one when it is desired to prevent rotation about their longitudinal axes. The inner end of each feeler pin can be provided with a recess of such a depth and form as to cooperate with control surfaces on the key. In this manner, even if the key in its end position abuts against the inner surface of the cylinder housing, the control surfaces on the key engage the feeler pins towards the cylinder axis.

While the invention has been illustrated and described as embodied in specific examples of a cylinder lock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cylinder lock comprising a core provided with a keyway defining an elongated center plane and being adapted for receiving and guiding a key, said key having a key bit formed with a rear bit portion and a front bit portion, at least one side of respective rear and front bit portions being provided with control projections and recesses and the at least one side of the front bit portion being provided with guiding grooves and ribs, a cylinder housing for said core, first tumbler means arranged in said housing and said core and being controlled by the control projections and recesses on the front bit portion, auxiliary tumbler means arranged in said core at locations which are spaced apart from said first tumbler means and cooperating with corresponding recesses in said housing, feeler elements arranged for reciprocating movement in said core between said auxiliary tumbler means and said keyway, said feeler elements forming an oblique angle with the center plane of said keyway and being controllable by the control projections and recesses on said rear bit portion to control the movement of said auxiliary tumbler means, said auxiliary tumbler means including an axial groove formed in the periphery of said core, a continuous bar movable in axial direction in said groove, said continuous bar being formed with inner extensions engageable with said feeler elements, and with opposite outer extensions projecting towards said housing, said housing including an axial recess for accommodating said outer extension and being also formed with a series of radial grooves for guiding said outer extensions in one axial position of said continuous bar while the walls of said axial groove in said housing act as stop surfaces for said outer extensions in another position of said bar.

2. A cylinder lock as defined in claim 1, further including a stop ring rotatably supported between said core and said housing, said stop ring having recessed camming surfaces, one end of said continuous bar being formed with run-on surfaces cooperating with said camming surfaces in order to axially displace said continuous bar between said position in which said outer extensions are in register with said radial grooves and the other position in which said outer extensions are limited in movement by the side walls of said axial groove.

3. A cylinder lock as defined in claim 2, wherein said continuous arresting bar is spring biased against said stop ring.

4. A cylinder lock as defined in claim 3, further including a ball arrester for releasably arresting said stop ring relative to said housing.

* * * * *